US008714428B2

(12) United States Patent
Mallard et al.

(10) Patent No.: US 8,714,428 B2
(45) Date of Patent: May 6, 2014

(54) SHEET PRODUCT DISPENSER

(75) Inventors: David Mallard, Munich (DE); Bruce Robbins, Richmond, VA (US); Anthony Rogers, Holland, PA (US)

(73) Assignee: Reynolds Consumer Products Inc., Richmond, VA (US)

( * ) Notice: Subject to any disclaimer, the term of this patent is extended or adjusted under 35 U.S.C. 154(b) by 1288 days.

(21) Appl. No.: 12/509,104

(22) Filed: Jul. 24, 2009

(65) Prior Publication Data

US 2011/0017765 A1 Jan. 27, 2011

(51) Int. Cl.
*B26F 3/02* (2006.01)

(52) U.S. Cl.
USPC ..... 225/58; 225/77; 225/91

(58) Field of Classification Search
USPC ..... 225/39, 91, 32, 65, 66, 77, 33, 46, 48, 225/52, 58; 221/32, 30, 45; 206/225, 233, 206/389
See application file for complete search history.

(56) References Cited

U.S. PATENT DOCUMENTS

| | | | | | |
|---|---|---|---|---|---|
| 325,992 | A | * | 9/1885 | Thain | 33/485 |
| 1,915,736 | A | * | 6/1933 | Hurlbut | 225/19 |
| 1,952,431 | A | * | 3/1934 | Gluck et al. | 206/54 |
| 2,031,033 | A | | 2/1936 | Denebeim | |
| 2,472,712 | A | | 6/1949 | Lifschitz | |
| D166,804 | S | | 5/1952 | De Grace | |
| D185,052 | S | | 4/1959 | Warp | |
| 3,070,273 | A | * | 12/1962 | Warp | 225/58 |
| 3,197,102 | A | * | 7/1965 | Bates et al. | 225/58 |
| 3,679,146 | A | | 7/1972 | Klitzke | |
| D236,226 | S | | 8/1975 | Jamois et al. | |
| 4,196,647 | A | * | 4/1980 | Fish | 83/175 |
| 4,424,926 | A | | 1/1984 | Gatward | |
| 4,739,943 | A | | 4/1988 | Geller | |
| D308,445 | S | | 6/1990 | Loughridge | |
| 5,135,134 | A | * | 8/1992 | Dancy | 221/61 |
| 5,275,321 | A | | 1/1994 | Manu et al. | |
| D357,377 | S | | 4/1995 | Manu et al. | |
| 5,480,080 | A | * | 1/1996 | Ferguson | 225/1 |
| 5,630,563 | A | | 5/1997 | Meisner et al. | |

(Continued)

FOREIGN PATENT DOCUMENTS

| | | |
|---|---|---|
| EP | 0 351 196 | 1/1990 |
| FR | 2 697822 | 5/1994 |
| GB | 2 111 019 | 6/1983 |
| WO | 93/24394 | 12/1993 |

*Primary Examiner* — Omar Flores Sanchez
(74) *Attorney, Agent, or Firm* — Paul F. McQuade; Greenberg Traurig, LLP

(57) ABSTRACT

A sheet product dispenser includes a housing to partially enclose a roll of sheet product, at least one end-opening at a longitudinal end of the housing to load said roll within the housing, and a longitudinal slit along a length of the housing to allow a leading edge of said sheet product to be unrolled therethrough defined by an upper and lower lip of the housing. The upper lip can flex to contact the lower lip to hold the sheet product in place during a cutting operation. The dispenser may further include a deforming projection disposed on a portion of the lower lip to deform the sheet product during a cutting operation to prevent roll-back of the sheet product.

38 Claims, 9 Drawing Sheets

(56) References Cited

U.S. PATENT DOCUMENTS

| | | | | |
|---|---|---|---|---|
| 5,850,960 | A | 12/1998 | Cadwell | |
| 6,105,481 | A | 8/2000 | Schuler | |
| 6,763,988 | B2 | 7/2004 | Huang | |
| 7,424,843 | B2 * | 9/2008 | Guillory | 83/614 |
| D595,075 | S * | 6/2009 | Ramos Peon | D6/518 |
| D626,862 | S * | 11/2010 | Augustenborg | D9/735 |
| 2008/0073371 | A1 | 3/2008 | Neiberger et al. | |
| 2010/0072243 | A1 * | 3/2010 | Pelton et al. | 225/49 |

* cited by examiner

SHEET PRODUCT DISPENSER

COPYRIGHT NOTIFICATION

This application includes material which is subject to copyright protection. The copyright owner has no objection to the facsimile reproduction by anyone of the patent disclosures, as it appears in the Patent and Trademark Office files or records, but otherwise reserves all copyrights whatsoever.

BACKGROUND OF THE DISCLOSURE

1. Field of the Invention

The present invention relates to a sheet product dispenser, and more particularly, to a reusable dispenser for sheet product, such as aluminum foil.

2. Description of the Related Art

Sheet products are used in a variety of industries. Perhaps the most well known sheet products are those used by consumers, including, without limitation, aluminum foil, plastic wrap, waxed paper, and parchment paper. These sheet products are typically sold to consumers or other end-users as elongate sheets which are rolled around a core, thereby allowing sheet products capable of covering a large area to be stored in a relatively small container.

Sheet products have been on the market for many years, and sheet product manufacturers spend a great deal of time and effort to create new forms of sheet products. Although manufacturers have focused on the composition and performance of the sheet products themselves, sheet product manufacturers have not significantly advanced sheet product packaging in many years. Sheet product packaging typically consists of a paperboard box into which a roll of sheet product is placed. In most cases, the user opens the box lid, pulls out a desired length of sheet product, and then closes the lid. Typically, either the lid or the base of the box includes serrated metal or plastic teeth that are then used to cut the sheet product to the desired length.

While such packaging is functional, it has proven to have disadvantages for consumers. For example, the end of the sheet product may fall back into the box after the cutting process, thereby necessitating that the user open the box and find the end before a new sheet product piece can be cut. For some sheet products, such as plastic wrap, this can be a difficult process. Some in the art have addressed this through the use of adhesive strips or other attachment means on the box which help hold the sheet product in place, but such strips can also attract foreign particles.

The packaging is frequently handled while a user is cooking or otherwise preparing or putting away foods, and the user's hands are typically wet or may have flour, grease, or other material on them. The rectangular shape of traditional sheet good packages makes it awkward and uncomfortable for the user to hold during the dispensing process due to the squared edges which do not conform well to the user's hand. This can result in stress on the user's hand and improperly dispensed, and thus wasted, sheet goods. Still further, because the packages are typically made of opaque paperboard, it is difficult for users to judge the amount of sheet goods remaining on the roll without removing the roll from the box.

Moreover, the conventional packaging is often designed to be disposable. A typical paperboard container is simply disposed of after the roll is exhausted. Often, the presence of a metal edge on the paperboard container will interfere with the recycling of the paper container. Environmental concern about the disposal of waste products have pushed manufacturers to redesign many products to reduce excessive packaging and reduce an overall environmental impact of packaging used.

SUMMARY OF THE DISCLOSURE

The present invention provides a sheet product dispenser which is reusable, easily refillable, and easy to grasp.

The present invention also provides a reusable sheet product dispenser designed to prevent roll-back of the sheet product dispensed.

The present invention also provides a reusable sheet product dispenser designed to hold a leading edge of the sheet product in place during a cutting operation.

The present invention also provides a reusable sheet product dispenser with features designed to facilitate a use and storage of the sheet product dispenser and to easily determine an amount of sheet product remaining therein.

Additional aspects and advantages of the present invention will be set forth in part in the description which follows and, in part, will be obvious from the description, or may be learned by practice of the present invention.

The foregoing and/or other aspects and utilities of the present invention may be achieved by providing a sheet product dispenser, including a housing to partially enclose a roll of sheet product, the housing including at least one end-opening defined at a longitudinal end of the housing to load said roll within the housing, the at least one end-opening having a diameter at least larger than a diameter of said roll, a longitudinal slit along a length of the housing to allow a leading edge of said sheet product to be unrolled through said longitudinal slit, a length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product, a cutting edge disposed at an end of the lower lip to cut a section of unrolled sheet product, a deforming projection disposed on a portion of the lower lip projecting outward from the longitudinal slit to deform the sheet product during a cutting operation to prevent roll-back of the sheet product, wherein a height of the longitudinal slit corresponds to a gap between the lower and upper lips, and a height of the deforming projection is greater than the height of the gap in an area of the longitudinal slit corresponding to the deforming projection, and at least one end plug to cover the at least one end-opening and to support the roll of sheet material within the housing.

The housing can be made of a rigid, non-deformable, and flexible material.

The housing may flex during a cutting operation such that the upper lip contacts the lower lip to hold the sheet product unrolled through the longitudinal slit in place.

The upper lip may include a contacting portion on the upper portion of the longitudinal slit to contact the lower lip when the housing is flexed.

The deforming projection may be disposed adjacent to a contact point of the contacting portion.

The deforming projection may include a plurality of deforming projections.

A longitudinal width of the deforming projection may be wide enough to deform the sheet product so that it prevents rollback but not wide enough to interfere with unrolling of the sheet product through the longitudinal slit.

The dispenser may further include a second deforming projection disposed on a portion of the lower lip inward from the contact point to further deform the sheet product during a cutting operation.

The housing may include a rectangular flat plate formed into a tubular housing, one pair of parallel edges forming two end openings, and the other pair of parallel edges forming the top and bottom lip, respectively.

The cross section of the housing may be tear-shaped.

The at least one end plug may include a removable end plug disposed at a first end-opening, and a fixed end plug disposed on a second end-opening.

The removable end plug may include a translucent and/or transparent material to allow determination of a remaining amount of sheet product.

The fixed plug may be ultrasonically welded or glued to the second end-opening.

Each of the removable end plug and the fixed end plug may further include a self-centering projection to rotatably support the roll of sheet product.

The gap defining the longitudinal slit may be greater at at least one longitudinal end of the longitudinal slit than at a center portion thereof.

The longitudinal slit may be tapered such that the gap is greater at the longitudinal ends of the longitudinal slit.

The height of the deforming protrusion may be greater than a height of the gap at any point along the longitudinal slit.

The dispenser may further include a thumb ridge formed on an exterior surface of the upper lip to correspond with the deforming projection.

The dispenser may further include a thumb ridge formed on an exterior surface of the upper lip to correspond with the contacting portion.

The cutting edge may be integrally formed with the lower lip.

The cutting edge may include a serrated portion integrally formed on the lower lip.

The cutting edge may include a metal or plastic cutting edge coupled to the lower lip.

An external shape of the lower lip may be at least partially flat to allow said housing to rest on a flat surface in a stable fashion.

An external shape of at least one end-opening may be at least partially flat to allow said housing to stand-up on its side on a flat surface in a stable fashion.

The housing may be made of molded plastic or a metal material.

The sheet product may include an aluminum foil sheet product, a plastic film sheet product, or a deformable material.

A thickness of the plate forming the housing may be about 0.080+/−0.030 inches.

A length of the self-centering projections may be about 1.430+/−0.020 inches.

A height of the gap in the area corresponding to the deforming projection may be about 0.075+/−0.025 inches.

A ratio of the height of the gap to the height of the deforming projection may be set to allow the deforming projection to deform the sheet product without creating a destructive tear in the sheet product after the cutting operation.

The height of the deforming projection may be 0.120+/−0.025 inches.

The foregoing and/or other aspects and utilities of the present invention may be achieved by providing a sheet product dispenser, including a housing made of a rigid flexible material to partially enclose a roll of sheet product, the housing including at least one end-opening at a longitudinal end of the housing to load said roll within the housing, a longitudinal slit along a length of the housing to allow a leading edge of said sheet product to be unrolled through said longitudinal slit, the length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product as it is unrolled, a cutting edge disposed at an end of the lower lip to cut a section of unrolled sheet product, wherein the upper lip can flex to contact the projecting lower lip to hold the sheet product in place during a cutting operation, and at least one end plug to cover the at least one end-opening and to support the roll of sheet material within the housing.

The housing may further include a holding projection disposed on a portion of the lower lip projecting outward from the longitudinal slit to hold the sheet product during the cutting operation to prevent roll-back of the sheet product, wherein a height of the longitudinal slit corresponds to a gap between the lower and upper lips, and a height of the deforming projection is greater than a height of the gap at an area of the longitudinal slit corresponding to the deforming projection.

The holding projection may deform the sheet product during a cutting operation to prevent roll back.

The holding projection may allow the sheet material to cling to the holding projection after a cutting operation.

The sheet product may include a deformable material.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION

Figure 1:
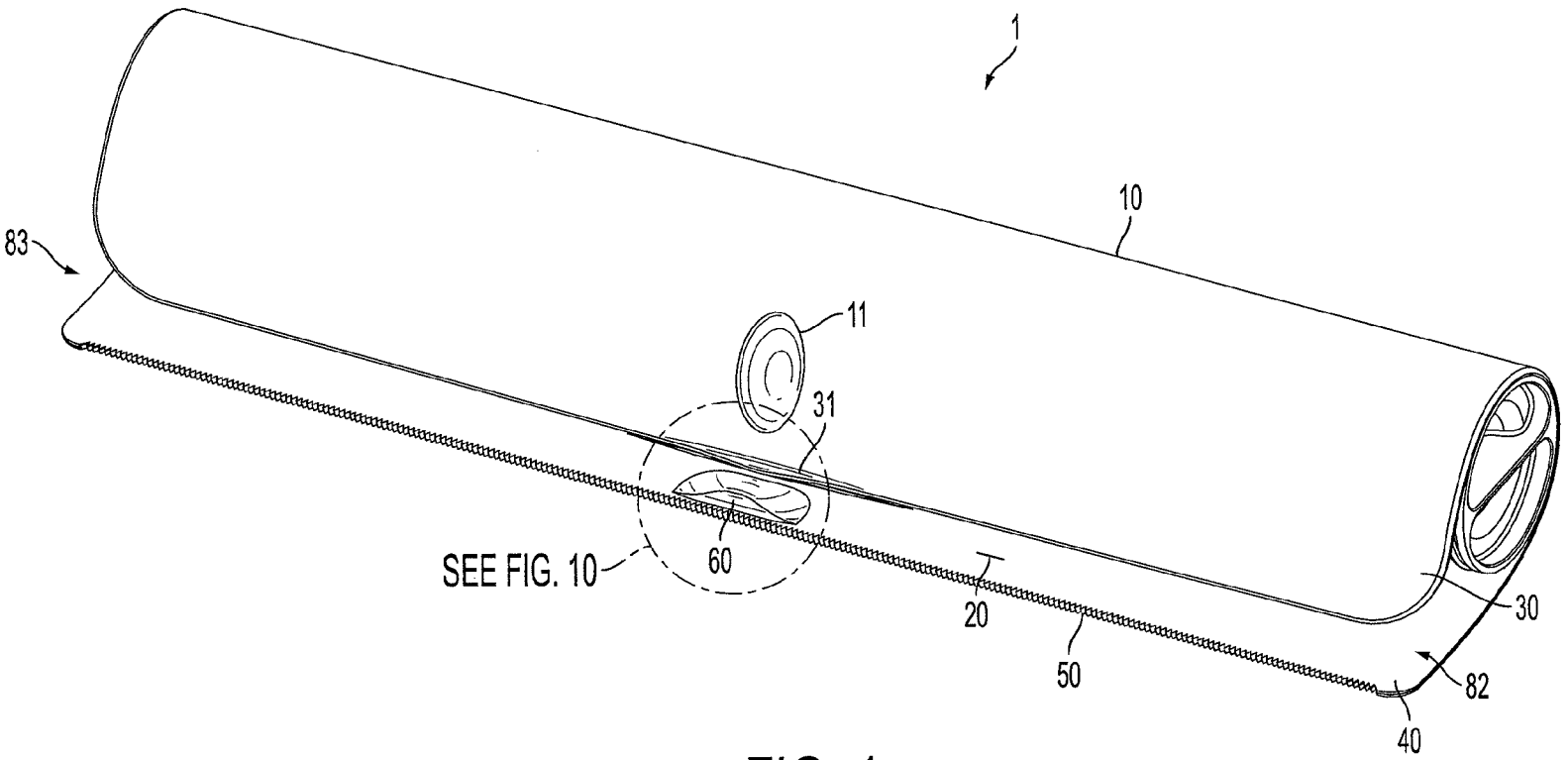
FIG. 1 is a perspective view of a sheet product dispenser according to one embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIGS. 1-10 illustrate a sheet product dispenser (1) according to an embodiment of the present invention. Referring to FIGS. 1-10, the sheet product dispenser (1) includes a housing (10) to partially enclose a roll of sheet product (not illustrated) therein. The housing (10) can be made of a rigid and/or non-deformable material, such as ABS or molded plastic, metal, wood, etc. Plastics could be low density polyethylene, high density polyethylene, polystyrene, polyethylene terephthalate, poly vinyl chloride, polypropylene or similar plastics. Metals could be aluminum, steel, stainless steel, copper, brass, etc. If made from metal, a thickness of the housing (10) material can be substantially thinner.

Figure 6:
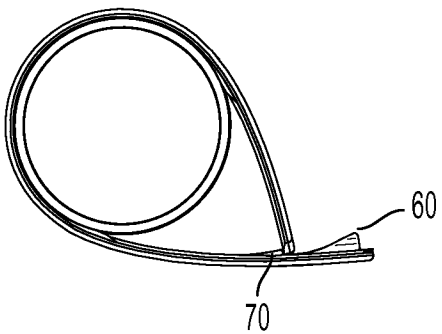
FIG. 6 is another first side view of the sheet product dispenser illustrated in FIG. 1 in a second position.
Figure 5:
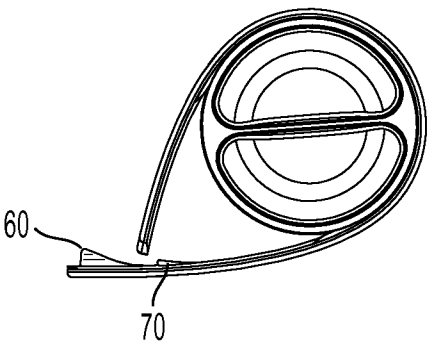
FIG. 5 is a second side view of the sheet product dispenser illustrated in FIG. 1.
Figure 4:
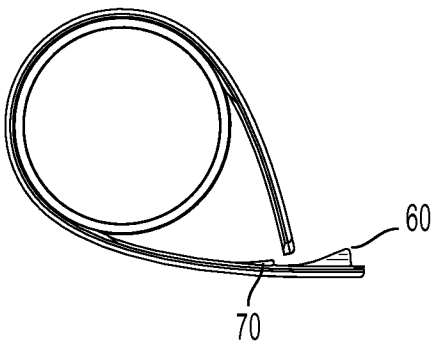
FIG. 4 is a first side view of the sheet product dispenser illustrated in FIG. 1 in a first position.
Figure 7:
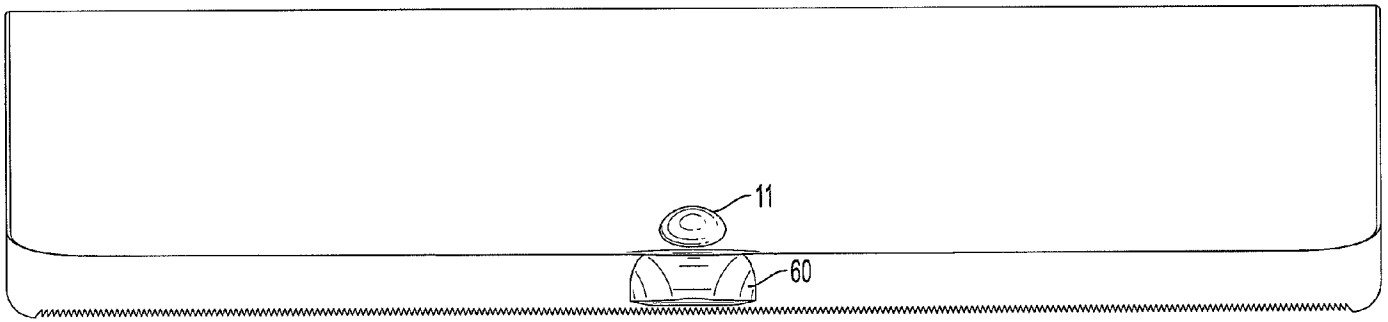
FIG. 7 is a top view of the sheet product dispenser illustrated in FIG. 1.
Figure 8:
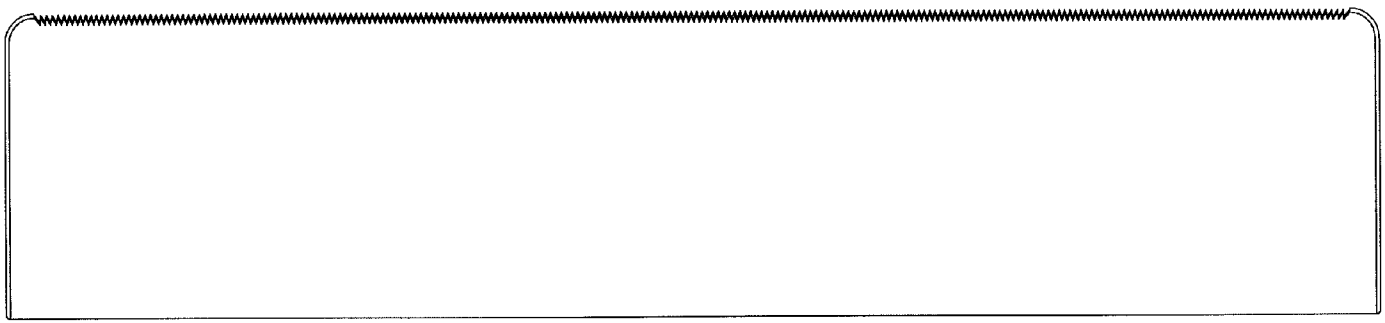
FIG. 8 is a bottom view of the sheet product dispenser illustrated in FIG. 1.

The housing (10) can be made of a single plate of material formed into a tubular shape. The housing (10) can be extruded into the tubular shape, or alternatively, can be extruded in planar shape and folded into the tubular shape. As illustrated in FIGS. 4-6, a cross-section of the housing (10) can be quasi tear-shaped. Housing (10) can also be molded into final shape by injection or compression molding.

The housing (10) defines a longitudinal slit (20) along an open length of the housing to allow a leading end of the sheet product to be unrolled through the longitudinal slit (20).

Figure 12:
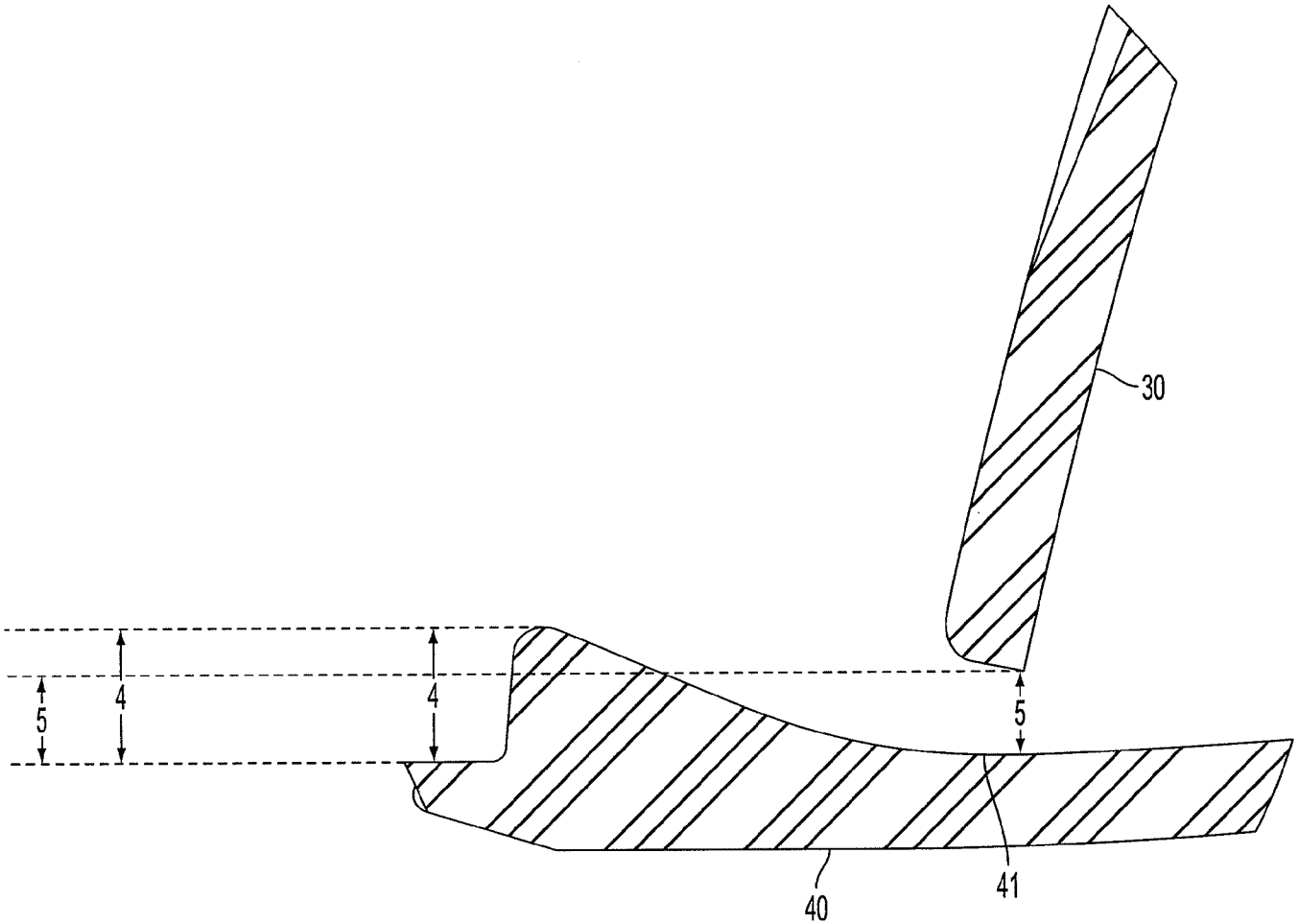
FIG. 12 illustrates an enlarged scale view of the longitudinal slit of the sheet product dispenser illustrated in FIG. 1.

As illustrated in FIGS. 1, 4-6, and 12, the longitudinal slit (20) is defined by an upper lip (30) and a lower lip (40) of the housing (10). The longitudinal slit (20) may correspond to a gap between an upper surface of the lower lip (40) and the upper lip (30). The lower lip (40) projects outward from the longitudinal slit (20), while the upper lip (30) can be directed toward the upper surface of the lower lip (40), as illustrated in FIG. 12.

The longitudinal slit (20) can have a uniform height along a length of the housing (10). Alternatively, the height of the longitudinal slit (20) may vary towards a center and/or one or both distal ends thereof, as described below.

The lower lip (40) extends outward from the longitudinal slit (20) to support a leading edge of the sheet product unrolled through the longitudinal slit (20). The extended portion of the lower lip (40) supporting the leading edge of the sheet product allows a user to grasp and unroll the leading edge of sheet product from within the housing after the roll of sheet product is initially loading into the housing (10).

As illustrated in FIGS. 1 and 12, a cutting edge (50) can be disposed at an end of the lower lip (40). The cutting edge (50) can comprise a cutting edge portion coupled to the lower lip (40), for example, a serrated metal edge coupled to the lower lip. The lower lip (40) may include an indented portion formed on the upper surface thereon to receive the cutting edge portion. Alternatively, as illustrated in FIG. 1, the cutting edge (50) can be integrally formed with the lower lip (40). The cutting edge (50) may comprise, for example, a serrated edge, a sharp edge, or any combination of the two. In an embodiment of the invention, the serrated edge may comprise a plurality of teeth tapered to a point projecting outward from the cutting edge (50). The serrate teeth can have a height of about 0.063 inches, and the teeth may be distanced to about 0.051 inches between the points of the teeth.

During a cutting operation, a leading edge of sheet product is unrolled through the longitudinal slit (20), pressed against the cutting edge (50), and linearly severed along the cutting edge (50).

As described above, the housing (10) can be made of a rigid and/or non-deformable material. However, since the housing (10) can be formed into an open tubular shape, the housing is also flexible.

Figure 13:
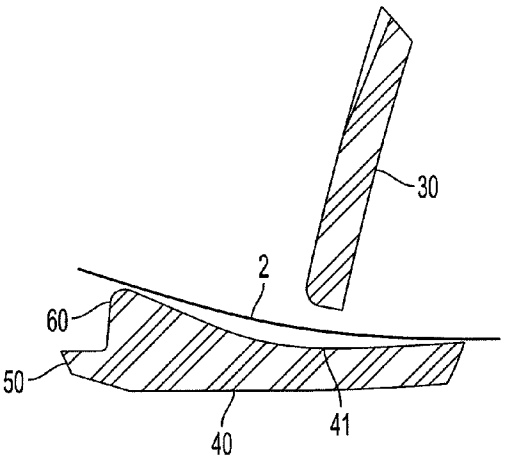
FIGS. 13-15 illustrate a deforming and/or cutting operation according to an embodiment of the present invention.
Figure 14:
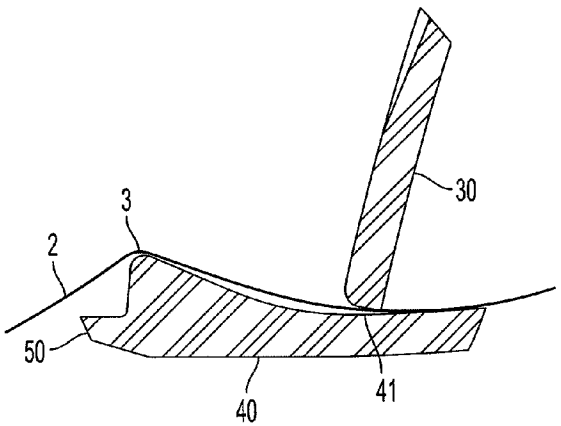
Figure 15:
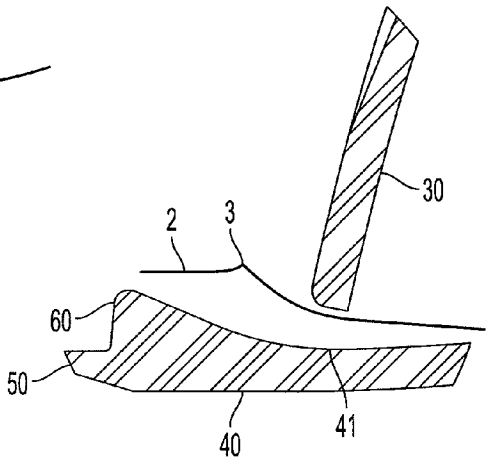

As illustrated in FIGS. 13-15, a leading edge of sheet product (2) is unrolled through the longitudinal slit (20) during a first part of the cutting operation. Then, the housing (10) can be flexed such that the upper lip (30) contacts the lower lip (40) at a contact point (41), thus holding the leading edge of sheet product (2) stationary. The leading edge is then pressed against the cutting edge (50) and linearly severed.

While an embodiment of the invention flexes the housing (10) to hold the leading edge of the sheet product in place during cutting of the leading edge with the cutting edge (50), the present invention is not limited thereto, and the cutting operation with the cutting edge (50) can be performed with or without flexing of the housing (10).

Figure 10:
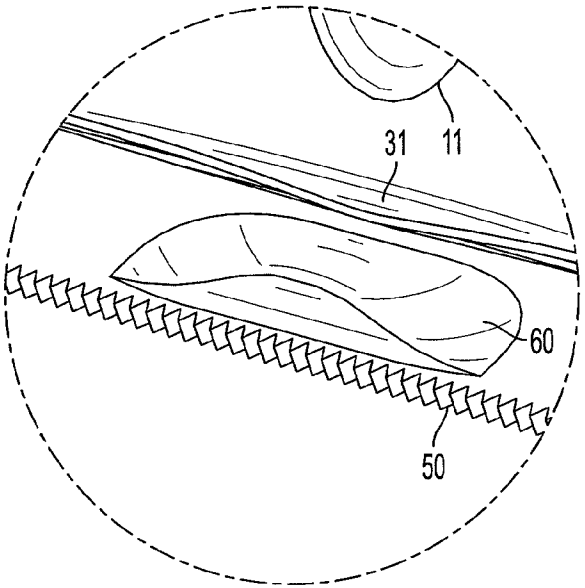
FIG. 10 is an enlarged scale of the deforming projection illustrated in FIG. 1.
Figure 11:
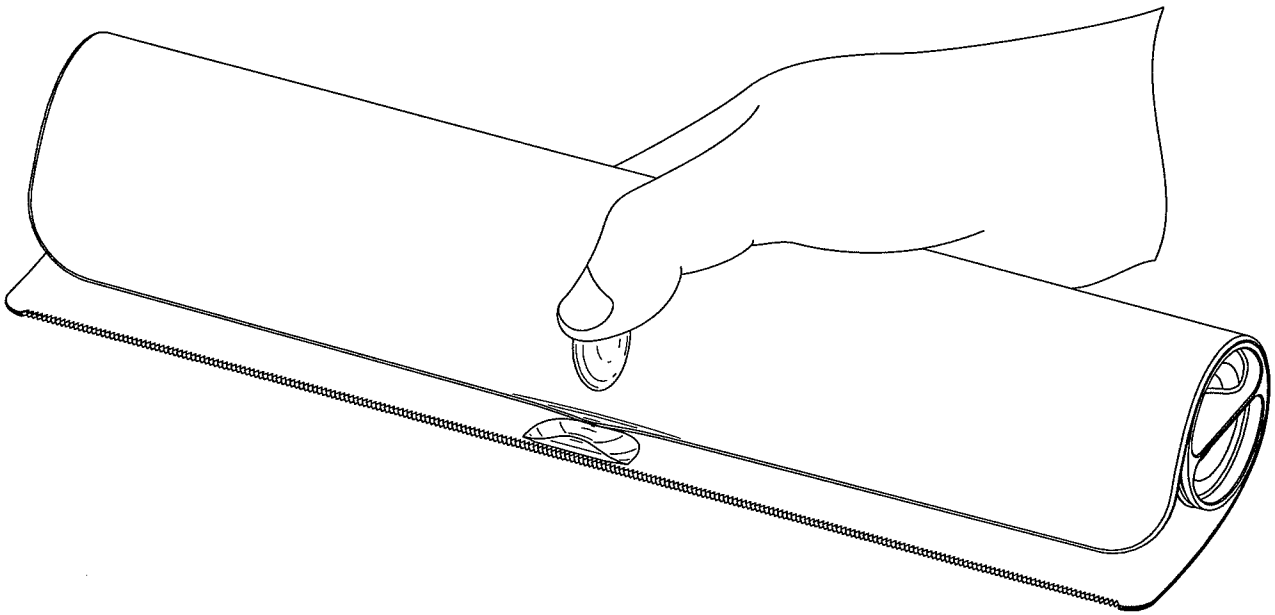
FIG. 11 illustrates one embodiment of a user pressing an upper surface of the sheet product dispenser illustrated in FIG. 1.

The lower lip (40) can also include a deforming protrusion (60) on an upper surface thereof. As illustrated in FIGS. 1 and 10, the deforming protrusion (60) can be disposed on the upper surface of the lower lip (40) at a position away from the longitudinal slit (20) and forward of the contact point (41).

During a cutting operation, when the leading edge of the sheet product is cut against the cutting edge (50), the deforming protrusion (60) contacts the sheet product and deforms the sheet product as illustrated in FIGS. 13-14.

As illustrated in FIGS. 14-15, the deforming protrusion (60) deforms a portion (3) of the leading edge of sheet product (2) forward of the longitudinal slit (20). The deformed portion (3) creates an obstacle to prevent roll-back of the leading edge of sheet product (2) back through the longitudinal slit (20).

The deforming protrusion (60) can be integrally formed with the housing. Alternatively, the deforming protrusion (60) can be separately formed and then coupled to the upper surface of the lower lip (40). The deforming protrusion (60) can comprise a plurality of deforming protrusions (60) disposed along a length of the upper surface of lower lip (40), disposed forward of a contact point (41).

The roll-back prevention ability of the deforming protrusion (60) can be improved by dimensioning the deforming protrusion (60) according to a corresponding portion of the longitudinal slit (20). For example, as illustrated in FIGS. 4-6 and 12, a height (4) of the deforming protrusion (60) can be greater than a height (5) of the longitudinal slit (20) in an area adjacent to the deforming protrusion (60).

If the height (4) of the deforming protrusion (60) is much greater than the height (5) of the adjacent longitudinal slit (20), the deforming protrusion (60) can interfere with the unrolling of the leading edge of sheet product through the longitudinal slit (20) toward the cutting edge (50). If the height (4) of the deforming protrusion (50) is much smaller than the height (5) of the adjacent longitudinal slit (20), the leading edge of the sheet product (2) may not be sufficiently deformed to prevent roll-back of the leading edge of sheet product (2) back through the longitudinal slit (20).

The height (5) of the longitudinal slit (20) adjacent to the deforming protrusion (60) can be about 55-65% of the height (4) of the deforming protrusion (60). Alternatively, the deforming protrusion (60) can be about 60-70% taller than the adjacent longitudinal slit (20). According to one embodiment of the present invention, the height (5) of the longitudinal slit (20) can be 0.073+/−0.010 inches in the area adjacent to the deforming protrusion (60), and a height (4) of the deforming protrusion can exceed the height of the longitudinal slit by 0.047+/−0.010 inches, as illustrated in FIG. 12.

As illustrated in FIGS. 4-6, the housing (10) may also include a second deforming protrusion (70) on an upper surface of the lower lip (40). The second deforming protrusion (70) can be disposed behind the contact point (41) and prior to the longitudinal slit (20) as illustrated in FIGS. 4-6.

According to an embodiment of the invention including the second protrusion, the housing (10) is flexed to hold the leading edge of sheet product in place during a cutting operation, such that when the leading edge of the sheet product is cut against the cutting edge (50), the first and second deforming protrusion deform the sheet product.

The second deforming protrusion (70) can include a plurality of second deforming protrusions (70) disposed behind the longitudinal slit (20). A height of the second deforming protrusion (70) can be dimensioned according to a height of the longitudinal slit (20) adjacent to the second deforming protrusion (70). If the height of the second deforming protrusion (70) is too high, the second deforming protrusion may interfere with the unrolling of the leading edge of sheet product through the longitudinal slit (20) toward the cutting edge (50).

According to one embodiment of the invention, the second deforming protrusion (70) can have a height equal to or smaller than an adjacent height of the longitudinal slit (20).

Figure 2:
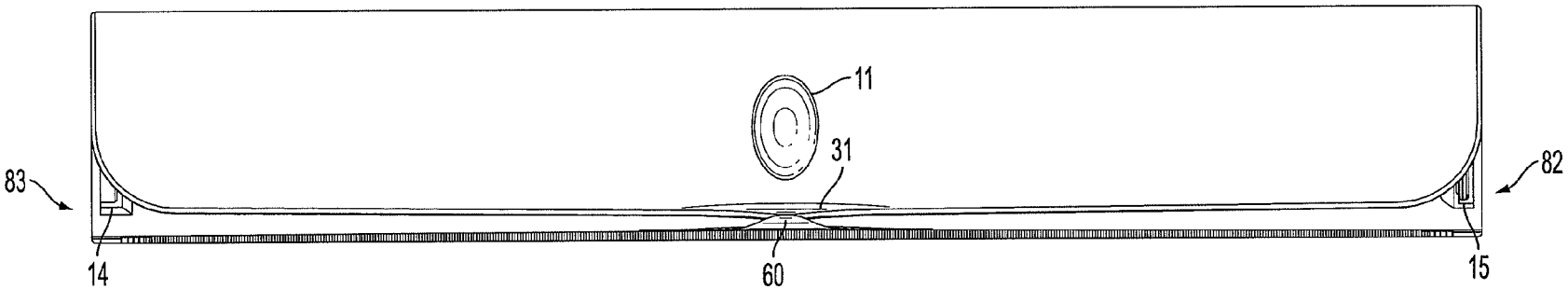
FIG. 2 is a front view of the sheet product dispenser illustrated in FIG. 1.
Figure 3:
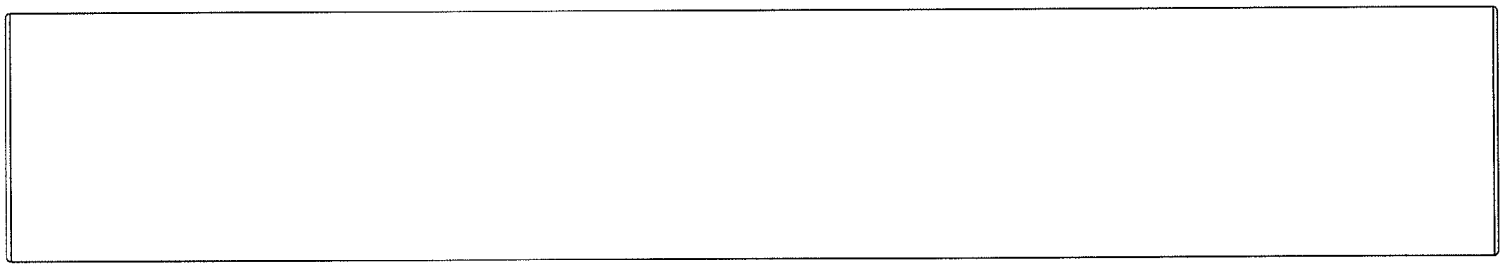
FIG. 3 is a back view of the sheet product dispenser illustrated in FIG. 1.

As described above, the height of the longitudinal slit (20) can vary along a length of the housing (10). For example, the longitudinal slit (20) can expand at one or both distal ends thereof. As illustrated in FIGS. 1-2, the longitudinal slit (20) may comprise one or two distal openings (82 and 83) at distal ends of the longitudinal slit (20).

The distal openings (82 and 83) can be defined by a tapered and/or rounded edge of the upper lip in an area corresponding to the upper distal portions of the longitudinal slit (20).

The distal openings (82 and/or 83) may facilitate a loading of the roll of sheet product into the housing (10). Particularly, the distal openings (82 and/or 83) facilitate an initial loading of the leading edge of sheet product into the longitudinal slit, between the upper and lower lips (30 and 40).

As illustrated in FIGS. 2 and 10, the upper lip (30) can project to define a contacting portion (31) in a center portion thereof. The contacting portion (31) can be integrally formed with the upper lip (30). Alternatively, the contacting portion (31) can be separately formed and coupled to the upper lip (30). The contacting portion (31) can project from the upper lip (30) to narrow the longitudinal slit (20) in an area corresponding to the contacting portion (31).

When the housing is flexed, the contacting portion (31) can contact the contact point (41) on the upper surface of the lower lip (40) to hold the leading edge of sheet product stationary during a cutting operation. Alternatively, if the contacting portion (31) is not present, a larger portion of the longitudinal slit (20) between the distal end openings (82 and/or 83) can contact the contact point (41).

As illustrated in FIG. 2, the deforming projection (60) can be disposed on the upper surface of the lower lip (40) in an area corresponding to the contacting portion (31) disposed on the upper lip (30).

A width of the deforming projection (60) can correspond to a width of the contacting portion (31). For example, as illustrated in FIG. 2, the width of the deforming projection (60) can be narrower, about half, the width of the contacting portion (31). Alternatively, the width of the deforming projection (60) can be the same or greater than the width of the contacting portion (31).

The contacting portion (31) can concentrate a pressure point of the upper lip against the upper surface of the lower lip (40) to improve a hold of the leading edge of the sheet product (2) during a cutting operation.

By narrowing the longitudinal slit (20) in the area of the contacting portion (31), the longitudinal slit (20) can be tapered toward distal end openings (82 and 83) to facilitate a loading and unloading of the roll of sheet product as described above.

Further, by narrowing the longitudinal slit (20) in the area of the contacting portion (31) and the contacting point (41), the prevention of roll-back of the deformed sheet product by the deforming projection (60) and/or second deforming projection (70) is improved.

The housing (10) can further include a pressing indicator (11) to indicate to a user a preferred pressure area to flex the housing (10). As illustrated in FIGS. 1 and 10, the pressing indicator (11) can be disposed on an outer surface of the upper lip (30). The pressing indicator (11) can be integrally formed with the upper lip (30). Alternatively, the pressing indicator (11) can be formed separately and coupled to the upper lip (30).

As illustrated in FIG. 1, the pressing indicator (11) can include a finger indentation formed into the upper surface of the upper lip (30). However, the present invention is not limited thereto, and the pressing indicator can include other types of indicator to indicate a preferable pressure point. For example, the pressing indicator (11) may also include a raised ridge, an embossed area, a grip-surface, and/or sticker or other indicia of a preferred pressure point location.

Figure 9:
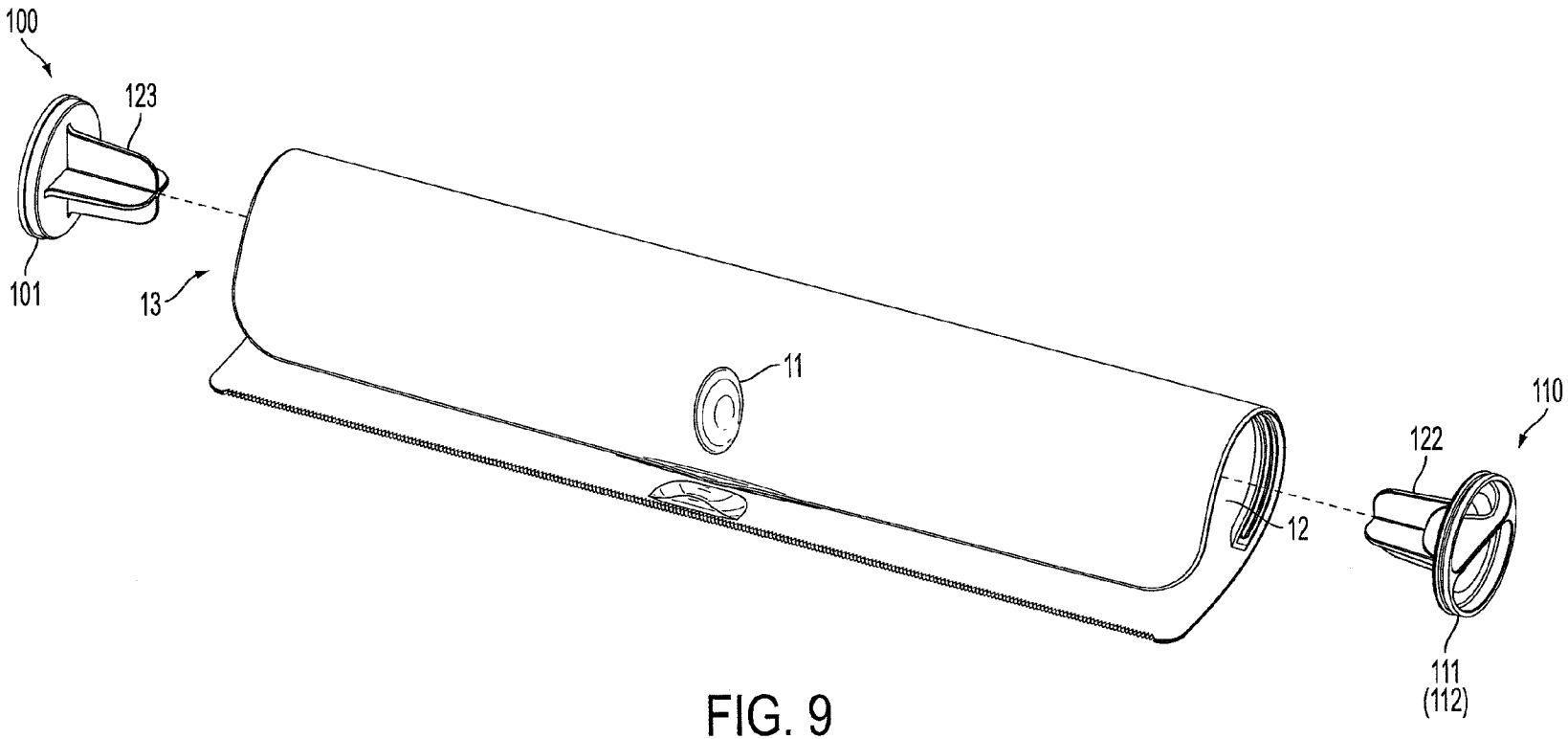
FIG. 9 is an exploded perspective view of the sheet product dispenser illustrated in FIG. 1.

As illustrated in FIG. 9, the housing (10) can define end openings (12 and 13) at ends thereof. The roll of sheet product can be loaded into the housing (10) through at least one of the end openings (12 and/or 13). As described above, the longitudinal slit (20) can expand at one or both distal ends thereof to define distal openings (82 and/or 83). The distal openings (82 and 83) can correspond to the end openings (12 and 13) to allow easier loading of the roll of sheet product into the housing (10), and particularly, to allow an easier initial loading of the leading edge of sheet product through the longitudinal slit (20).

One end opening (12 or 13) can be closed, while the other end opening (12 or 13) can be selectively open or closed. Alternatively, both end openings (12 and 13) can be selectively open or closed.

Various ways are available to close the end opening (12 or 13) within the scope of the present invention. For example, a wall or a plurality of ribs can be integrally formed with or coupled to the housing (10) to prevent a roll of sheet product from exiting the housing (10) through the closed end opening, a rod, or other physical barrier can also be coupled to end opening (12 or 13) to close the end opening, or a cover can be provided to attach to an outside of the housing (10) and close the end opening (13). Alternatively, as illustrated in FIG. 9, an end plug (100) can be coupled to end opening (13) to close end opening (13). The end plug (100) can be fixedly inserted to the end opening (13) to be non-removable or not easily removable. For example, the end plug (100) can be ultrasonically welded or glued to the end opening (13), or the end plug (100) can be screwed into place by cooperating threads formed in both the end plug (100) and corresponding portions of the end opening (13).

According to one embodiment of the present invention, the end plug (100) can have a circular shape to fit within the end opening (13). A diameter of the end plug (100) can be 1.72+/−0.010 inches, and the end plug (100) can include a lip (101) to facilitate coupling of the end plug (100) to the end opening (13), as illustrated in FIG. 9. For example, the lip (101) can provide a surface for ultrasonic welding of the end plug (100) to the opening (13), or a surface for application of a glue to couple the end plug (100) to the opening (13). Alternatively, the lip (101) can be threaded to screw the end plug (100) into the opening (13).

As illustrated in FIG. 2, the end opening (13) can also include a surface feature (14) to couple to the end plug (100). The surface feature (14) can include a threaded surface to cooperate with a threaded surface of the end plug (100). Alternatively, the surface feature (14) can include a mating surface to be ultrasonically welded or glued to the lip (101).

The end plug (100) can couple to a portion of the end opening (13). According to an embodiment of the present invention, the end plug (100) does not couple to portions of the upper lip (30) and/or lower lip (40) defining the longitudinal lip (20), as illustrated in FIG. 4. The partial coupling of the end plug (100) to the housing (10) allows the flexing of the upper and lower lips (30 and 40) when pressure is applied to the housing (10).

According to an embodiment of the present invention, one or both of the end openings (12 and 13) can be selectively open or closed. Various ways are within the scope of the present invention to allow one or both end openings (12 and/or 13) to be selectively open or closed. For example, an openable cover or flip-top can be attached to the housing (10) to provide selective access to one or both end openings (12 and 13), resilient members can be attached to the housing (10) to allow loading of the roll of sheet product into the housing (10) while preventing unintended exit of the roll of sheet product through the end opening. Alternatively, one or both end openings (12 and/or 13) can be provided with a removable end plug (110). As illustrated in FIG. 9, a removable end plug (110) can be removably inserted into the end opening (12). For example, the removable end plug (110) can be screwed into the end opening (12), or the removable end plug (110) can be "snapped" into place using cooperating grooves and ridges disposed on both the removable end plug (110) and an interior surface of the end opening (12). A removable cover can also be provided that removably attaches to an outside of the housing (10) to cover the end opening (12).

According to one embodiment of the present invention, the end plug (110) can have a circular shape to fit within the end opening (12), and a diameter of the end plug (110) can be 1.72+/−0.010 inches. The end plug (110) can include a lip (111) to facilitate removable coupling of the end plug (110) to the end opening (12). For example, the lip (111) can provide a threaded surface to cooperate with a threaded surface defined in the interior surface of the opening (12). Alternatively, as illustrated in FIG. 9, the lip (111) can include a grooved surface (112) to couple with another cooperating groove surface in an interior surface of the end opening (12) to allow the removable end plug to securely "snap" into a position to close the end opening (12). In one embodiment of the present invention, the housing (10) can be briefly flexed apart to allow for easier loading of the removable end plug (110) into the end opening (12).

As illustrated in FIG. 2, the end opening (12) can also include a surface feature (15) to removably couple to the end plug (110). The surface feature (15) can include a threaded surface to cooperate with a threaded surface of the end plug (110). Alternatively, the surface feature (15) can include a cooperating groove surface to engage with a groove surface defined in the lip (111).

According to one embodiment of the present invention, the end plug (110) can couple to a portion of the end opening (12). As illustrated in FIG. 5, the end plug (110) does not couple to portions of the upper lip (30) and/or lower lip (40) defining the longitudinal lip (20). The partial coupling of the end plug (110) to the housing (10) allows the flexing of the upper and lower lips (30 and 40) when pressure is applied to the housing (10).

As illustrated in FIG. 9, an external surface of the removable end plug (110) can be contoured or molded to allow, for example, easier grasping of the end plug (110) by an user, easier turning on the end plug within the end opening (12), and/or easier removal of the end plug (110).

Both the fixed and removable end plugs (100 and 110) can be made of a same material as the housing (10). Alternatively, one or both end plugs (100 and 110) can include a translucent or transparent material to allow a user to determine an amount of sheet product remaining in the roll.

The dispenser (1) can also include a support to rotatably support the roll of sheet product within the housing (10). For example, the support can be embodied as a pair of projections (122 and 123) disposed on the end plugs (100 or 110) to rotatably support the roll of sheet product.

The projections can be disposed on a surface of the end plug (100 or 110) facing the corresponding end opening (12 and/or 13) and may project inward within the housing (10). As illustrated in FIG. 9, the projections can be embodied as self-centering and/or tapered cruciforms (122 and 123). the cruciforms (122 and 123) suspend the roll of sheet product therebetween, allowing the roll of sheet product to rotatably "float" within the dispenser. The projection can be integrally formed with the end plugs (100 and 110) or can be separately formed and then coupled to the end plugs (100 and 110). However, the scope of the present invention is not limited thereto, and other supports can be used to rotatably support the roll of sheet product within the dispenser (1). For example, an axle or wire can be disposed between the end plugs (100 and 110) to support the roll of sheet product.

One or both of the end openings (12 and 13) can be formed flat, such that the dispenser (1) can stand freely when placed on its side. Additionally, the end plugs (100 and/or 110) can be formed so as to also be flat once coupled to end openings (12 and 13) to allow the dispenser (1) to stand on its side, as illustrated in FIGS. 1-2.

As illustrated in FIGS. 1-6, at least a portion of the lower lip 40 can be flat to allow the dispenser (1) to rest easily on a surface. Additionally, portions of the lower lip can define mounts to allow the dispenser (1) to be mounted on a wall or other surface. For example, the mounts can be holes to support a screw, a nail, a hanger, etc., or can be embodied as double sided tape or Velcro-type adhesive surfaces, magnets, etc.

Although a few embodiments of the present invention have been shown and described, it will be appreciated by those skilled in the art that changes may be made in these embodiments without departing from the principles and spirit of the present invention, the scope of which is defined in the appended claims and their equivalents.

What is claimed is:

1. A sheet product dispenser, comprising:

a housing to partially enclose a roll of sheet product, the housing comprising:

at least one end-opening defined at a longitudinal end of the housing to load said roll within the housing, the at least one end-opening having a diameter at least larger than a diameter of said roll, a longitudinal slit along a length of the housing to allow a leading edge of said sheet product to be unrolled through said longitudinal slit, a length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product, a cutting edge disposed at an end of the lower lip to cut a section of unrolled sheet product, a deforming projection disposed on a portion of the lower lip projecting outward from the longitudinal slit to deform the sheet product during a cutting operation to prevent roll-back of the sheet product, wherein a height of the longitudinal slit corresponds to a gap between the lower and upper lips, and a height of the deforming projection is greater than the height of the gap in an area of the longitudinal slit corresponding to the deforming projection;

wherein the gap defining the longitudinal slit is smaller at a center portion of the longitudinal slit corresponding to the deforming projection; and at least one end plug to cover the at least one end-opening and to support the roll of sheet material within the housing.

2. The dispenser of claim 1, wherein the housing is made of a rigid, non-deformable, and flexible material.

3. The dispenser of claim 2, wherein the housing is flexed during a cutting operation such that the upper lip contacts the lower lip to hold the sheet product unrolled through the longitudinal slit in place.

4. The dispenser of claim 3, wherein the upper Up comprises a contacting portion on the upper portion of the longitudinal slit to contact the lower lip when the housing is flexed.

5. The dispenser of claim 4, wherein the deforming projection is disposed adjacent to a contact point of the contacting portion.

6. The dispenser of claim 1, wherein the deforming projection comprises a plurality of deforming projections.

7. The dispenser of claim 4, wherein a longitudinal width of the deforming projection is wide enough to deform the sheet product so that it prevents rollback but not wide enough to interfere with unrolling of the sheet product through the longitudinal slit.

8. The dispenser of claim 5, further comprising:

a second deforming projection disposed on a portion of the lower lip inward from the contact point to further deform the sheet product during a cutting operation.

9. The dispenser of claim 1, wherein the housing comprises a rectangular flat plate formed into a tubular housing, one pair of parallel edges forming two end openings, and the other pair of parallel edges forming the top and bottom lip, respectively.

10. The dispenser of claim 1, wherein the cross section of the housing is tear-shaped.

11. The dispenser of claim 9, wherein the at least one end plug comprises:

a removable end plug disposed at a first end-opening, and a fixed end plug disposed on a second end-opening.

12. The dispenser of claim 11, wherein the removable end plug comprises a translucent and/or transparent material to allow determination of a remaining amount of sheet product.

13. The dispenser of claim 11, wherein the fixed plug is ultrasonically welded or glued to the second end-opening.

14. The dispenser of claim 11, wherein each of the removable end plug and the fixed end plug further comprises a self-centering projection to rotatably support the roll of sheet product.

15. A sheet product dispenser, comprising:

a housing to partially enclose a roll of sheet product, the housing comprising:

at least one end-opening defined at a longitudinal end of the housing to load said roll within the housing, the at least one end-opening having a diameter at least larger than a diameter of said roll, a longitudinal slit along a length of the housing to allow a leading edge of said sheet product to be unrolled through said longitudinal slit, a length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product, a cutting edge disposed at an end of the lower lip to cut a section of unrolled sheet product, a deforming projection disposed on a portion of the lower lip projecting outward from the longitudinal slit to deform the sheet product during a cutting operation to prevent roll-back of the sheet product, wherein a height of the longitudinal slit corresponds to a gap between the lower and upper lips, and a height of the deforming projection is greater than the height of the gap in an area of the longitudinal slit corresponding to the deforming projection;

wherein the longitudinal slit is tapered such that the gap is greater at the longitudinal ends of the longitudinal slit and the gap is smaller at a center portion of the longitudinal slit corresponding to the deforming projection; and at least one end plug to cover the at least one end-opening and to support the roll of sheet material within the housing.

16. The dispenser of claim 1, wherein the height of the deforming protrusion is greater than the height of the gap at any point along the longitudinal slit.

17. The dispenser of claim 15, wherein the height of the deforming protrusion is greater than a height of the gap at any point along the longitudinal slit.

18. A sheet product dispenser, comprising:

a housing to partially enclose a roll of sheet product, the housing comprising:

at least one end-opening defined at a longitudinal end of the housing to load said roll within the housing, the at least one end-opening having a diameter at least larger than a diameter of said roll, a longitudinal slit along a length of the housing to allow a leading edge of said sheet product to be unrolled through said longitudinal slit, a length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product, a cutting edge disposed at an end of the lower lip to cut a section of unrolled sheet product, a deforming projection disposed on a portion of the lower lip projecting outward from the longitudinal slit to deform the sheet product during a cutting operation to prevent roll-back of the sheet product, wherein a height of the longitudinal slit corresponds to a gap between the lower and upper lips, and a height of the deforming projection is greater than the height of the gap in an area of the longitudinal slit corresponding to the deforming projection;

a thumb ridge formed on an exterior surface of the upper lip to correspond with the deforming projection; and at least one end plug to cover the at least one end-opening and to support the roll of sheet material within the housing.

19. The dispenser of claim 18, further comprising:

a thumb ridge formed on an exterior surface of the upper lip to correspond with the contacting portion.

20. The dispenser of claim 18, wherein the cutting edge is integrally formed with the lower lip.

21. The dispenser of claim 18, wherein the cutting edge comprises a serrated portion integrally formed on the lower lip.

22. The dispenser of claim 18, wherein the cutting edge comprises a metal or plastic cutting edge coupled to the lower lip.

23. The dispenser of claim 18, wherein an external shape of the lower lip is at least partially flat to allow said housing to rest on a flat surface in a stable fashion.

24. The dispenser of claim 18, wherein an external shape of at least one end-opening is at least partially flat to allow said housing to stand-up on its side on a flat surface in a stable fashion.

25. The dispenser of claim 1, wherein the housing is made of molded plastic.

26. The dispenser of claim 1, wherein the housing is made of a metal material.

27. The dispenser of claim 1, wherein the sheet product comprises an aluminum foil sheet product.

28. The dispenser of claim 1, wherein the sheet product comprises a plastic film sheet product.

29. The dispenser of claim 1, wherein the sheet product comprises a deformable material.

30. The dispenser of claim 1, wherein a thickness of the plate forming the housing is about 0.080.+−.0.030 inches.

31. The dispenser of claim 14, wherein a length of the self-centering projections is about 1.430.+−.0.020 inches.

32. The dispenser of claim 18, wherein a height of the gap in the area corresponding to the deforming projection is about 0.075.+−.0.025 inches.

33. The dispenser of claim 18, wherein a ratio of the height of the gap to the height of the deforming projection is set to allow the deforming projection to deform the sheet product without creating a destructive tear in the sheet product after the cutting operation.

34. The dispenser of claim 32, wherein the height of the deforming projection is about 0.120.+−.0.025 inches.

35. A sheet product dispenser, comprising:

a housing made of a rigid flexible material to partially enclose a roll of sheet product, the housing comprising:

at least one end-opening at a longitudinal end of the housing to load said roll within the housing, a longitudinal slit along a length of the housing to allow a leading edge of said sheet product to be unrolled through said longitudinal slit, the length of the longitudinal slit corresponding to a width of the sheet product, an upper lip defining an upper portion of the longitudinal slit, a lower lip defining a lower portion of the longitudinal slit and projecting outward from the longitudinal slit to support the leading edge of the sheet product as it is unrolled, a cutting edge disposed at an end of the lower lip to cut a section of unrolled sheet product, a holding projection disposed on a portion of the lower lip behind the longitudinal slit to prevent roll-back of the sheet product, wherein a height of the longitudinal slit corresponds to a gap between the lower and upper lips, and a height of the holding projection is smaller or equal to a height of the gap at an area of the longitudinal slit corresponding to the holding projection, and wherein the upper lip can flex to contact the projecting lower lip to hold the sheet product in place during a cutting operation; and at least one end plug to cover the at least one end-opening and to support the roll of sheet material within the housing.

36. The dispenser of claim 35, wherein the holding projection deforms the sheet product during a cutting operation to prevent roll back.

37. The dispenser of claim 35, wherein the holding projection allows the sheet material to cling to the holding projection after a cutting operation.

38. The dispenser of claim 35, wherein the sheet product comprises a deformable material.

* * * * *